US010128093B2

(12) United States Patent
Tate et al.

(10) Patent No.: US 10,128,093 B2
(45) Date of Patent: Nov. 13, 2018

(54) METHOD FOR DECONVOLUTION

(71) Applicant: DH Technologies Development Pte. Ltd., Singapore (SG)

(72) Inventors: Stephen A. Tate, Barrie (CA); John Lawrence Campbell, Milton (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/576,874

(22) PCT Filed: May 26, 2016

(86) PCT No.: PCT/IB2016/053099

§ 371 (c)(1),
(2) Date: Nov. 27, 2017

(87) PCT Pub. No.: WO2016/198984

PCT Pub. Date: Dec. 15, 2016

(65) Prior Publication Data

US 2018/0166263 A1 Jun. 14, 2018

Related U.S. Application Data

(60) Provisional application No. 62/174,264, filed on Jun. 11, 2015.

(51) Int. Cl.
*H01J 49/00* (2006.01)

(52) U.S. Cl.
CPC ..... *H01J 49/0036* (2013.01); *H01J 49/0027* (2013.01); *H01J 49/0031* (2013.01); *H01J 49/0072* (2013.01)

(58) Field of Classification Search
CPC .. H01J 49/004; H01J 49/0045; H01J 49/0027; H01J 49/0031; H01J 49/0036; H01J 49/0072; G01N 30/72
See application file for complete search history.

(56) References Cited

U.S. PATENT DOCUMENTS

2006/0169883 A1 8/2006 Wang et al.
2011/0303842 A1* 12/2011 Nakano ..... G01N 30/72 250/288

(Continued)

FOREIGN PATENT DOCUMENTS

WO 2008111911 A1 9/2008
WO 2010129187 A1 11/2010
WO 2015054468 A1 4/2015

OTHER PUBLICATIONS

International Search Report and Written Opinion for PCT/IB2016/053099, dated Sep. 12, 2016.

*Primary Examiner* — David E Smith
(74) *Attorney, Agent, or Firm* — John R. Kasha; Kelly L. Kasha; Kasha Law LLC

(57) ABSTRACT

Systems and methods prevent potentially convolved precursor ion peaks from being excluded in subsequent cycles of an IDA experiment so that additional product ion data is collected. A sample is ionized producing an ion beam. A plurality of cycles of an IDA experiment are performed on the ion beam. During each cycle of the IDA experiment and for each precursor ion peak on a filtered peak list produced in the filtering step of each cycle, several steps are performed. The precursor ion peak is identified in the precursor ion spectrum produced in the MS survey scan step of the cycle. It is determined if the precursor ion peak in the precursor ion spectrum includes a feature of convolution. If the precursor ion peak includes a feature of convolution, the precursor ion peak is prevented from being excluded in a filtering step of one or more subsequent cycles.

15 Claims, 10 Drawing Sheets

(56) References Cited

U.S. PATENT DOCUMENTS

| | | | | |
|---|---|---|---|---|
| 2012/0191369 | A1* | 7/2012 | Yamaguchi | H01J 49/0036 702/23 |
| 2013/0116934 | A1* | 5/2013 | Yamada | H01J 49/0036 702/28 |
| 2014/0312220 | A1 | 10/2014 | Simmons | |
| 2015/0130810 | A1* | 5/2015 | Yasuda | G06T 11/206 345/440 |

* cited by examiner

100

200

300

400

500

METHOD FOR DECONVOLUTION

CROSS REFERENCE TO RELATED APPLICATION

This application claims the benefit of U.S. Provisional Patent Application Ser. No. 62/174,264, filed Jun. 11, 2015, the content of which is incorporated by reference herein in its entirety.

INTRODUCTION

Information dependent analysis (IDA) is a flexible tandem mass spectrometry method in which a user can specify criteria for producing product ion spectra during a chromatographic run. For example, in an IDA method a precursor or mass spectrometry (MS) survey scan is performed to generate a precursor ion peak list. The user can select criteria to filter the peak list for a subset of the precursor ions on the peak list. The subset of precursor ions are then fragmented and product ion spectra are obtained repeatedly during the chromatographic run.

In a typical IDA method, a cycle consists of a single MS survey scan followed by N mass spectrometry/mass spectrometry (MS/MS) scans. After the MS survey scan, the precursor ion peak list is generated and filtered in real-time. For example, the peak list is generated by ranking the mass-to charge ratio (m/z) peaks of the MS survey scan spectrum from highest intensity to lowest intensity. The precursor ion peak list is then filtered.

Precursor ion peak list filtering can include, for example, a number of filtering steps. First, any precursor ions that were fragmented in an earlier cycle are excluded from the precursor ion peak list. Second, precursor ions on the peak list that are simply multiple charge states of the same precursor ion are collapsed into a single precursor ion with a single charge state. Third, precursor ions on the peak list that are within a certain m/z threshold or tolerance of a precursor ion that was previously fragmented are also excluded from the precursor ion list.

The N m/z peaks from the filtered precursor ion list with the highest intensity values are then selected for MS/MS analysis. As a result, each cycle consists of N MS/MS scans. A cycle is performed, for example, for each retention time of a chromatographic separation.

IDA is a useful technique for identifying proteins or peptides from peptide fragments. Typically, IDA is performed on a protein or peptide mixture, producing a plurality of product ion spectra for the peptide fragments that are produced. Each spectrum of the plurality of product ion spectra are then compared to a protein or peptide database in order to identify the proteins or peptides in the mixture.

Unfortunately, however, the protein or peptide identification can be adversely affected by mixed or convolved product ion spectra. In other words, some of the product ion spectra from the IDA method can include product ions from more than one precursor ion. As a result, when a mixed or convolved product ion spectrum is compared to a protein or peptide database, a match may not be found.

A number of methods have been proposed to deconvolve product ions produced from convolved precursor ions. In U.S. Provisional Patent Application Ser. No. 62/061,492, entitled "Improving IDA Spectral Output for Database Searches," a post-processing method for deconvolving product ions is described that compares the intensity pattern of product ions over two or more IDA cycles. Product ions that share the same pattern are then grouped together. By comparing the product ions in each group to a database of known product ions for precursor ions, the parent precursor ions that produced each group are determined. In this way both the product ions and the precursor ions are deconvolved.

This method of deconvolution relies on data collected over two or more cycles. In fact, the method works best when three or more data points are collected across a chromatographic peak.

Unfortunately, however and as described above, in most IDA methods when a precursor ion is fragmented in a cycle, it is excluded from being fragmented in any subsequent cycles. As a result, there is not enough data to perform deconvolution using methods such as the one described above.

Currently, the mass spectrometry industry lacks a real-time method of ensuring that enough data is collected in an IDA method in order to apply a deconvolution method when precursor ions are potentially convolved. More simply, the mass spectrometry industry lacks a method of preventing previously fragmented precursor ions from being excluded in an IDA method, when those precursor ions may be convolved.

SUMMARY

A system is disclosed for preventing potentially convolved precursor ion peaks from being excluded in subsequent cycles of an information dependent analysis (IDA) experiment so that additional product ion data is collected. The system includes an ion source, a mass spectrometer, and a processor.

The ion source ionizes a sample received over time producing an ion beam. The mass spectrometer receives the ion beam from the ion source and is adapted to perform a plurality of cycles of an IDA experiment on the ion beam. Each cycle of the plurality of cycles includes a number of steps. In a mass spectrometry (MS) survey scan step, a precursor ion mass spectrum is produced. In a peak list step, the peaks of the precursor ion mass spectrum are ranked by intensity. In a filtering step, precursor ions that were fragmented in a previous cycle are excluded from the peak list and a subset of peaks from the peak list with the highest intensities are selected, producing a filtered peak list. In a mass spectrometry/mass spectrometry step (MS/MS) step, an MS/MS scan is performed on each precursor ion on the filtered peak list, producing a product ion spectrum for each MS/MS scan.

During each cycle of the plurality of cycles, the processor performs a number of steps for each precursor ion peak on a filtered peak list produced in a filtering step. The processor identifies the precursor ion peak in a precursor ion spectrum produced in a MS survey scan step, and determines if the precursor ion peak in the precursor ion spectrum includes a feature of convolution. If the precursor ion peak includes a feature of convolution, the processor instructs the mass spectrometer to prevent the precursor ion peak from being excluded in a filtering step of one or more subsequent cycles of the plurality of cycles.

A method is disclosed for preventing potentially convolved precursor ion peaks from being excluded in subsequent cycles of an information dependent analysis (IDA) experiment so that additional product ion data is collected.

A sample received over time is ionized and an ion beam is produced using an ion source. A plurality of cycles of an IDA experiment is performed on the ion beam using a mass spectrometer. Each cycle of the IDA experiment includes a number of steps. In an MS survey scan step, a precursor ion mass spectrum is produced. In a peak list step, the peaks of the precursor ion mass spectrum are ranked by intensity. In a filtering step, precursor ions that were fragmented in a previous cycle are excluded from the peak list and a subset of peaks from the peak list with the highest intensities are selected, producing a filtered peak list. In an MS/MS step, an MS/MS scan is performed on each precursor ion on the filtered peak list, producing a product ion spectrum for each MS/MS scan.

During each cycle of the IDA experiment and for each precursor ion peak on a filtered peak list produced in the filtering step of each cycle, a number of steps are performed. The precursor ion peak is identified in the precursor ion spectrum produced in the MS survey scan step of the cycle using a processor. It is determined if the precursor ion peak in the precursor ion spectrum includes a feature of convolution using the processor. If the precursor ion peak includes a feature of convolution, the mass spectrometer is instructed to prevent the precursor ion peak from being excluded in a filtering step of one or more subsequent cycles using the processor A computer program product is disclosed that includes a non-transitory and tangible computer-readable storage medium whose contents include a program with instructions being executed on a processor so as to perform a method for preventing potentially convolved precursor ion peaks from being excluded in subsequent cycles of an IDA experiment so that additional product ion data is collected. In various embodiments, the method includes providing a system, wherein the system comprises one or more distinct software modules, and wherein the distinct software modules comprise a control module and an analysis module.

The control module instructs an ion source to ionize a sample received over time and to produce an ion beam. The control module instructs a mass spectrometer to perform a plurality of cycles of an IDA experiment on the ion beam. Each cycle of the IDA experiment includes a number of steps. In an MS survey scan step, a precursor MS survey scan is performed, producing a precursor ion mass spectrum. In a peak list step, the peaks of the precursor ion mass spectrum are ranked by intensity. In a filtering step, among other things, precursor ions that were fragmented in a previous cycle are excluded from the peak list and a subset of peaks from the peak list with the highest intensities are selected, producing a filtered peak list. In an MS/MS step, an MS/MS scan is performed on each precursor ion on the filtered peak list, producing a product ion spectrum for each MS/MS scan.

During each cycle of the IDA experiment a number of steps are performed for each precursor ion peak on a filtered peak list produced in the filtering step of the cycle. The analysis module identifies the precursor ion peak in the precursor ion spectrum produced in the MS survey scan step. The analysis module determines if the precursor ion peak in the precursor ion spectrum includes a feature of convolution. If the precursor ion peak includes a feature of convolution, the control module instructs the mass spectrometer to prevent the precursor ion peak from being excluded in a filtering step of one or more subsequent cycles of the plurality of cycles of the IDA experiment.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
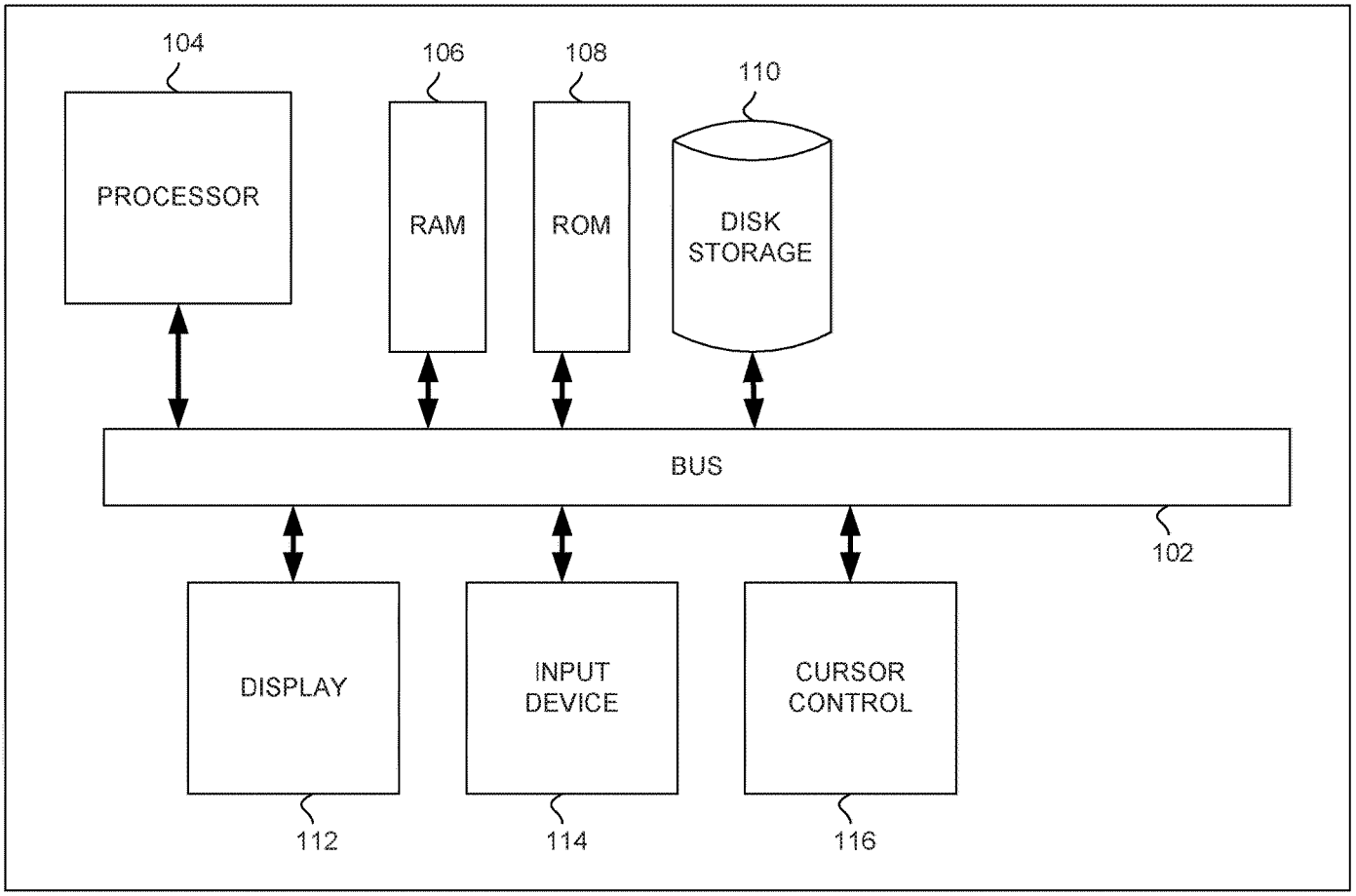
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Collecting IDA Spectra

As described above, the mass spectrometry industry lacks a real-time method of ensuring that enough data is collected in an information dependent analysis (IDA) method in order to apply a deconvolution method when precursor ions are potentially convolved. More simply, the mass spectrometry industry lacks a method of preventing previously fragmented precursor ions from being excluded in an IDA method, when those precursor ions may be convolved.

In various embodiments, in real-time a precursor ion on a filtered peak list in an IDA method is identified as including a feature of convolution from the precursor or mass spectrometry (MS) survey scan. The precursor ion is then added to a do not exclude list so that the precursor ion is fragmented over two or more cycles of the IDA method. In this way, it is ensured that enough mass spectrometry/mass spectrometry (MS/MS) data or product ion data is always collected to apply a deconvolution method to this data, which is something the mass spectrometry industry has been unable to obtain.

Figure 2:
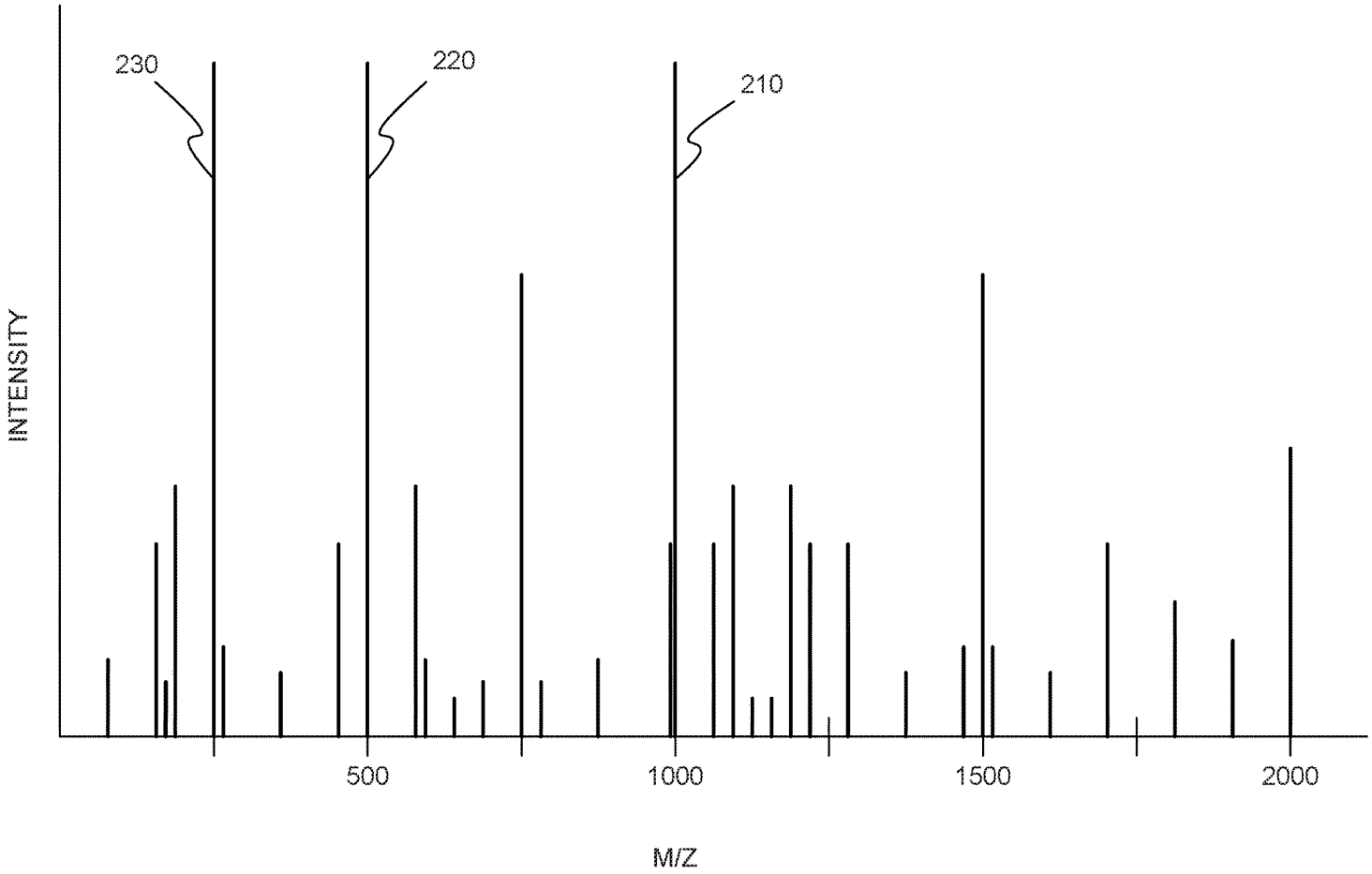
FIG. 2 is an exemplary plot of intensity versus mass-to-charge ratio (m/z) values from a precursor ion mass spectrometry (MS) survey scan taken during one cycle of an information dependent analysis (IDA) method, in accordance with various embodiments.

FIG. 2 is an exemplary plot 200 of intensity versus m/z values from a precursor ion MS survey scan taken during one cycle of an IDA method, in accordance with various embodiments. A peak list is generated by ranking the mass-to charge ratio (m/z) peaks of the MS survey scan spectrum from highest intensity to lowest intensity. For example, peaks 210, 220, and 230 in plot 200 all have the highest intensity. As a result, peaks 210, 220, and 230 are ranked highest on the peak list. The precursor ion peak list is then filtered.

For example, any precursor ions that were fragmented in an earlier cycle are excluded from the precursor ion peak list. Also, precursor ions on the peak list that are within a certain m/z threshold or tolerance of a precursor ion that was previously fragmented are also excluded from the precursor ion list.

In addition, precursor ions on the peak list that are simply multiple charge states of the same precursor ion are collapsed into a single precursor ion with a single charge state. For example, peak 210 has an m/z of 1000, peak 220 has an m/z of 500, and peak 230 has an m/z of 250. Peaks 210, 220, and 230, therefore, are the +1, +2, and +4 charge states of a precursor ion of mass 1000, respectively. As a result, peaks 220 and 230 are filtered from the peak list.

Figure 3:
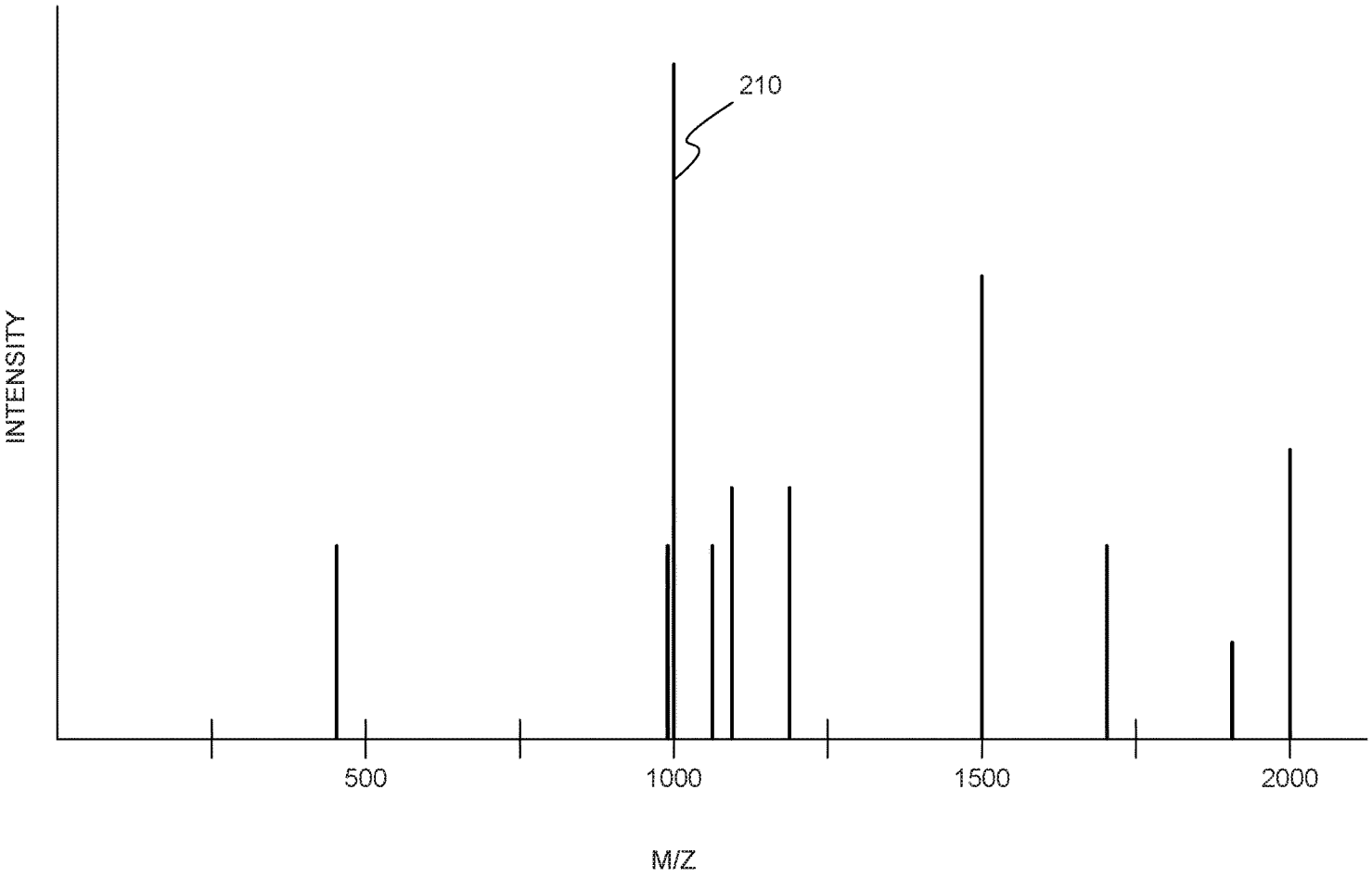
FIG. 3 is an exemplary plot of filtered intensity versus m/z values from a precursor ion MS survey scan taken during one cycle of an IDA method, in accordance with various embodiments.

FIG. 3 is an exemplary plot 300 of filtered intensity versus m/z values from a precursor ion MS survey scan taken during one cycle of an IDA method, in accordance with various embodiments. A peak list includes a maximum number, N, of peaks. In plot 300, N is 10. One of ordinary skill in the art can appreciate that the number of peaks on an IDA peak list can vary from method to method and can even vary from cycle to cycle. The maximum number of peaks in the peak list can be selected by a user or can be automatically calculated by the mass spectrometer based on the number of MS/MS scans that can be completed with one cycle, for example.

On comparison with FIG. 2, FIG. 3 shows that peaks 220 and 230 were excluded from the peak list. As a result, peak 210 is the highest ranked precursor ion in the filtered precursor ion peak list. Each precursor ion represented by each peak of FIG. 3 is fragmented and the product ions of each precursor ion are mass analyzed. In other words, an MS/MS scan is performed on each of the precursor ions represented in FIG. 3.

Conventionally, each precursor ion represented by each peak of FIG. 3 is excluded from the filtered peak list in subsequent cycles of the IDA method. For example, the precursor ion represented by peak 210 is conventionally excluded from the peak list in the next cycle, even if it is found again in the survey scan of the next cycle and has the highest intensity.

In various embodiments, however, before excluding a fragmented precursor ion from the peak list in the next cycle, the precursor ion peak is examined for a feature of convolution. Features of convolution can include, but are not limited to, decreased peak resolving power, more than one precursor ion in the MS/MS isolation window, a peak shape that exhibits convolution, or the absence of a known isotopic form of the precursor ion in the MS survey scan.

Resolving Power

Figure 4:
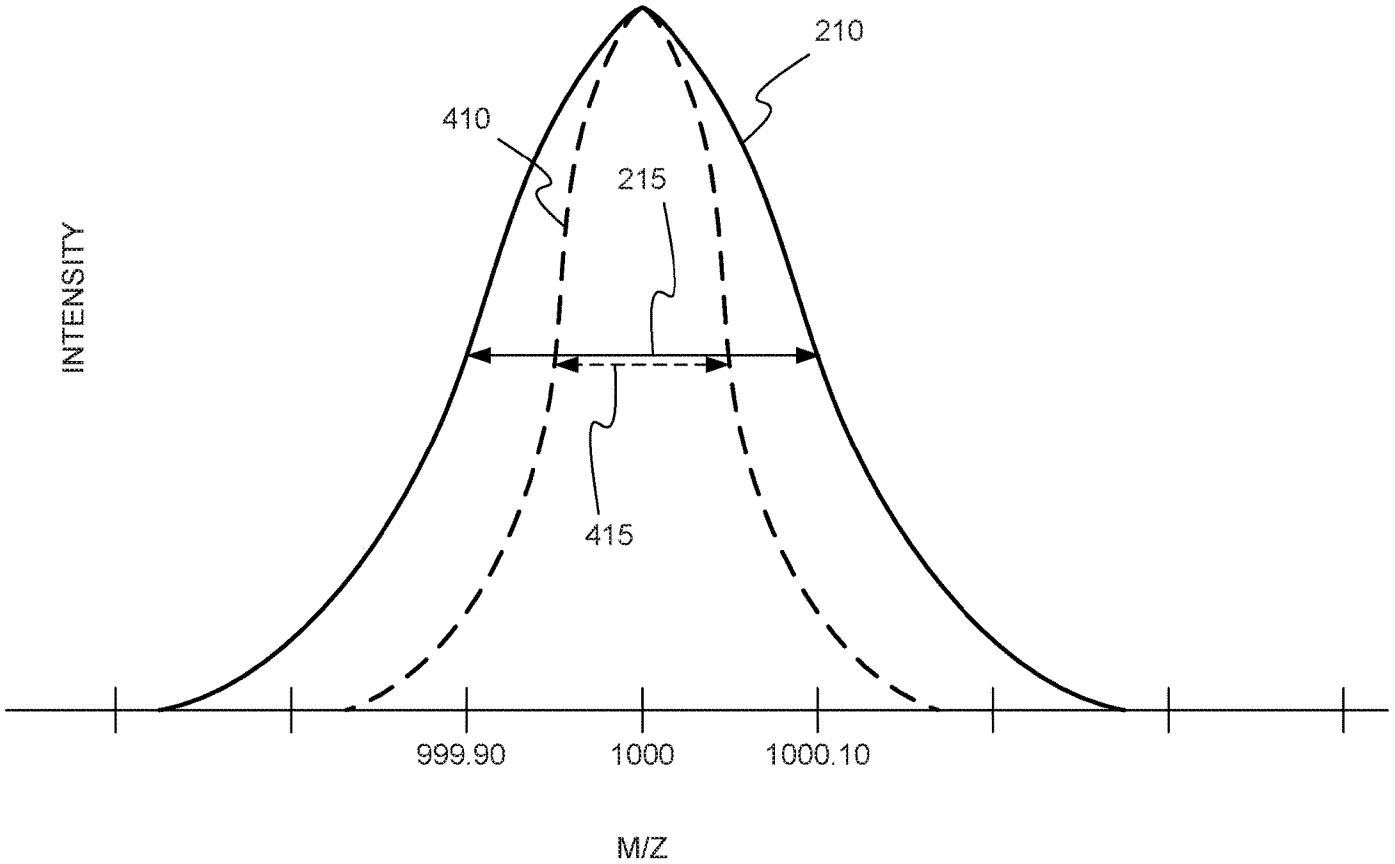
FIG. 4 is an exemplary plot of a detailed portion of the intensity versus m/z values from a precursor ion MS survey scan taken during one cycle of an IDA method showing a precursor ion peak that has a decreased peak resolving power, in accordance with various embodiments.

FIG. 4 is an exemplary plot 400 of a detailed portion of the intensity versus m/z values from a precursor ion MS survey scan taken during one cycle of an IDA method showing a precursor ion peak 210 that has a decreased peak resolving power, in accordance with various embodiments. Precursor ion peak 210 has an m/z value of 1000. The charge of ion peak 210 is +1, so the mass is also 1000.

Resolving power, R. is defined, for example, as a peak mass or m/z, m, divided by the peak width, Δm, necessary for separation at the peak mass, $R=m/\Delta m$. Resolving power is specific to each mass spectrometry instrument. For example, if the mass spectrometer used to provide the data for FIG. 4, has a resolving power of 10,000, then at an m/z, m, of 1,000, the peak width, Δm, necessary for separation is 1,000/10,000 or 0.1. Peak width is the full width at half maximum (FWHM), for example.

In FIG. 4, peak 410 is centered at mass 1,000. Peak 410 has peak width 415, which has a value of 0.1 (1000.05–999.95). Peak 410 is the precursor ion peak that should be seen at m/z 1,000 in a precursor ion MS survey scan of an IDA method, if the peak is not convolved with another precursor ion peak.

FIG. 4, however, shows the actual peak 210 that is found from the precursor ion MS survey scan of an IDA method at m/z 1,000. Peak 210 has peak width 215, which has a value of 0.2 (1000.10–999.90). The resolving power calculated from these values is 1,000/0.2, or 5,000. Since the resolving power, 5,000, of precursor ion peak 210 is less than the resolving power, 10,000, of the mass spectrometer, precursor ion peak 210 may be convolved with another precursor ion peak, and precursor ion peak 210, therefore, includes a feature of convolution.

Another way of looking at this data is to compare peak width 215 with peak width 415. For a mass spectrometer with a resolving power of 10,000, the peak width of an m/z at 1,000 should be 0.1, which is the value of peak width 415. Peak width 215 of precursor ion peak 210 is 0.2. Since the peak width of precursor ion peak 210 is greater than what the peak width should be for instrument with a resolving power of 10,000, precursor ion peak 210 may be convolved with another precursor ion peak, and precursor ion peak 210, therefore, includes a feature of convolution.

Number of Peaks in an Isolation in an Isolation Window

Figure 5:
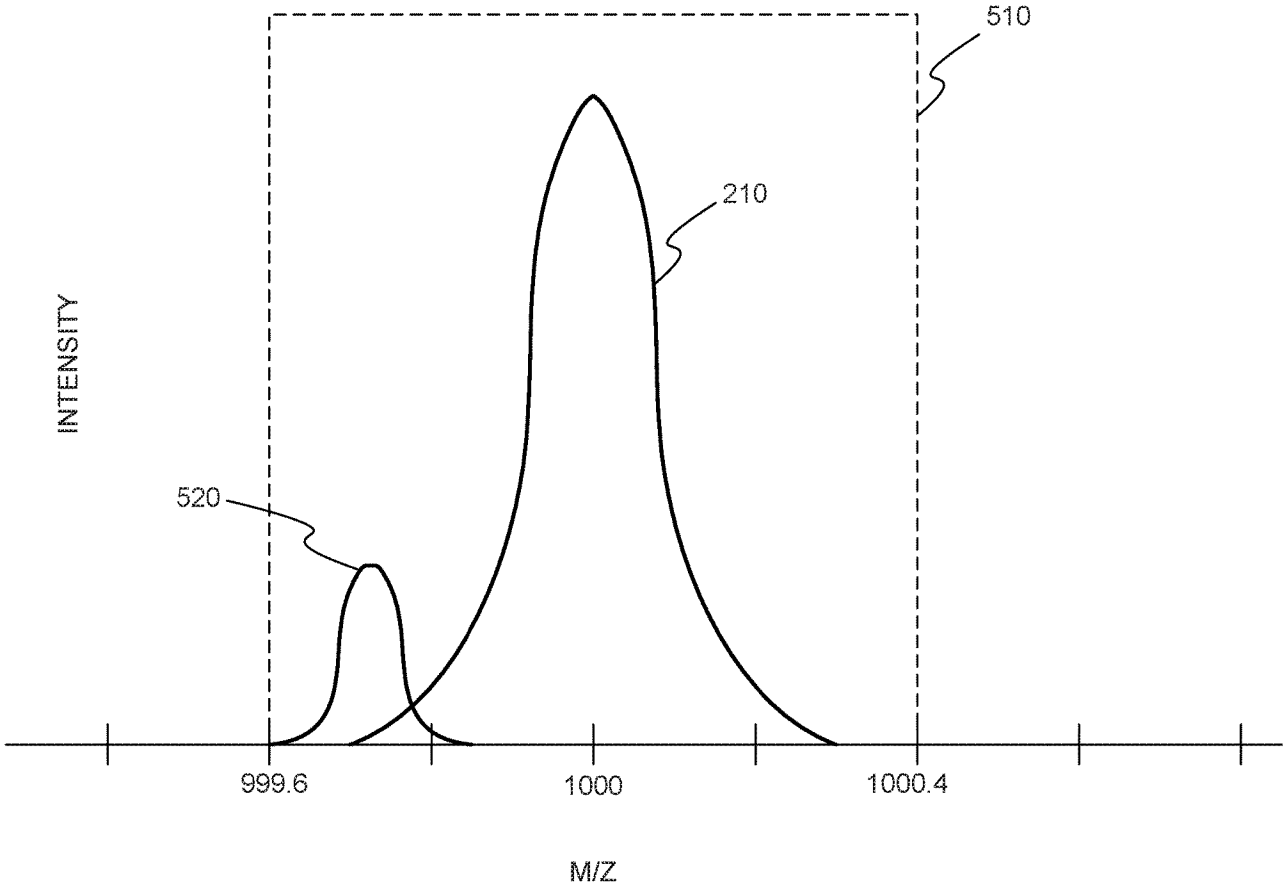
FIG. 5 is an exemplary plot of a detailed portion of the intensity versus m/z values from a precursor ion MS survey scan taken during one cycle of an IDA method showing more than one precursor ion in an isolation window around a precursor ion peak, in accordance with various embodiments.

FIG. 5 is an exemplary plot 500 of a detailed portion of the intensity versus m/z values from a precursor ion MS survey scan taken during one cycle of an IDA method showing more than one precursor ion in an isolation window 510 around a precursor ion peak 210, in accordance with various embodiments. Precursor ion peak 210 is a peak on the filtered peak list of an IDA method. Each peak on the filtered peak list is fragmented using a precursor ion isolation window. The width of the precursor ion isolation window is dependent, for example, on the mass spectrometer used. In FIG. 5, the width of precursor ion isolation window 510 is 0.8 m/z units.

In addition to precursor ion peak 210, isolation window 510 includes precursor ion peak 520. More than one precursor ion in an isolation window results in the fragmentation of more than one precursor ion. If two or more of the fragmented precursor ions produce products ions that have the same or almost the same m/z values, those product ions can be convolved. As a result, the presence of precursor ion peak 520 in isolation window 510 indicates that convolution may occur, and precursor ion peak 210 includes a feature of convolution.

Peak Shape

Figure 6:
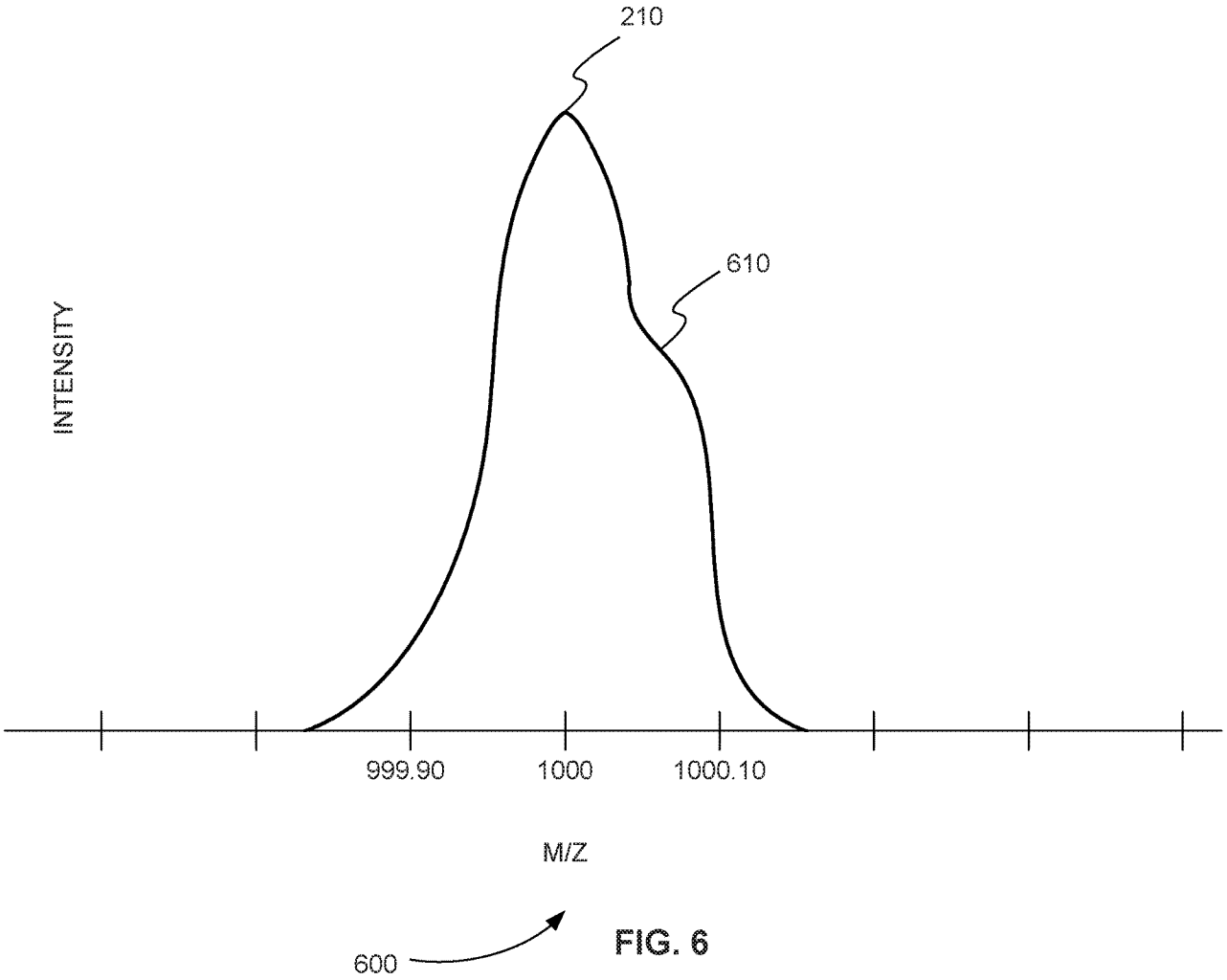
FIG. 6 is an exemplary plot of a detailed portion of the intensity versus m/z values from a precursor ion MS survey scan taken during one cycle of an IDA method showing a peak shape that exhibits convolution, in accordance with various embodiments.

FIG. 6 is an exemplary plot 600 of a detailed portion of the intensity versus m/z values from a precursor ion MS survey scan taken during one cycle of an IDA method showing a peak shape that exhibits convolution, in accordance with various embodiments. Precursor ion peak 210 is a peak on the filtered peak list of an IDA method. The peak shape of precursor ion peak 210 includes a shoulder 610. A peak shape that varies from known shapes produced by mass spectrometers indicates that the precursor ion represented by the peak may be convolved with another precursor ion and is another feature of convolution. Therefore, shoulder 610 of precursor ion peak 210 indicates that the precursor ion represented by precursor ion peak 210 may be convolved with another precursor ion, and precursor ion peak 210 includes a feature of convolution.

Absence of Isotopic Pattern

Figure 7:
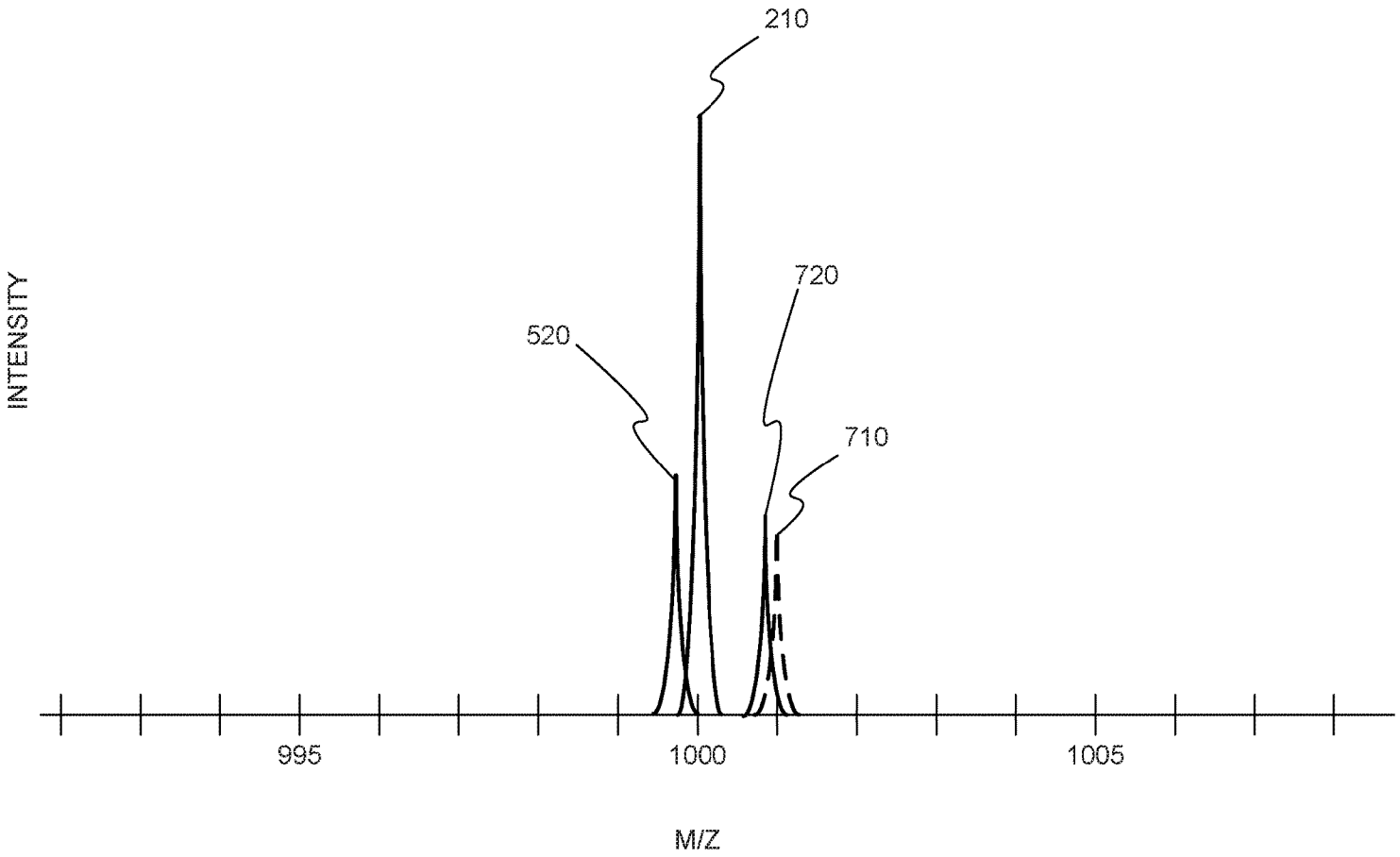
FIG. 7 is an exemplary plot of a detailed portion of the intensity versus m/z values from a precursor ion MS survey scan taken during one cycle of an IDA method showing the absence of a known isotopic form of a precursor ion in the MS survey scan, in accordance with various embodiments.

FIG. 7 is an exemplary plot 700 of a detailed portion of the intensity versus m/z values from a precursor ion MS survey scan taken during one cycle of an IDA method showing the absence of a known isotopic form of a precursor ion in the MS survey scan, in accordance with various embodiments. Precursor ion peak 210 is a peak on the filtered peak list of an IDA method. Precursor ion peak 210 represents the m/z of a known compound. An isotopic pattern can be calculated from the m/z of a known compound. If, for example, the precursor ion represented by precursor ion peak 210 is known to include carbon 12, a precursor ion peak 710 representing a precursor ion isotope including carbon 13 should be found at m/z 1001. However, instead ion peak 720 is found at a lower m/z value. The absence of precursor ion peak 710 indicates that the isotope of precursor ion peak 210 may have been convolved with an isotope of another precursor ion peak such as precursor ion peak 520, for example. As a result, the absence of a known isotopic form of precursor ion peak 210 in the MS survey indicates that the precursor ion represented by precursor ion peak 210 includes a feature of convolution.

As described above, if a precursor ion on the filtered peak list of an IDA method includes a feature of convolution, the precursor ion is not excluded from the filtered peak list of the next cycle so that additional product ion data can be collected for the precursor ion. This additional data can be used to deconvolve the product ions. The precursor ion is not excluded, for example, by adding it to a "do not exclude list." The do not exclude list is then interrogated during each cycle of the IDA method when the filtered peak list is being created.

For each precursor ion on the do not exclude list there is also stored a number of cycles during which the precursor ion should not be excluded. The number of cycles is decremented each time the precursor ion is additionally fragmented.

In various embodiments, the number of cycles during which the precursor ion should not be excluded is a function of the number of other precursor ions that may be convolved with the precursor ion of the filtered peak list. For example, if one additional precursor ion is found in the isolation window of a precursor ion on the filtered peak list, the number of cycles during which the precursor ion should not be excluded is one or two. If two additional precursor ions are found in the isolation window of the precursor ion on the filtered peak list, the number of cycles during which the precursor ion should not be excluded is two or three. In other words, when a precursor ion on the filtered peak list is found to be convolved with other ions, the number of additional cycles over which data should be collected for the precursor ion is proportional to read number of other precursor ions that are convolved with the precursor ion.

In various embodiments, the number of cycles during which the precursor ion should not be excluded is dependent upon the algorithms used to deconvolve the convolved product ions. For example, if a deconvolution algorithm requires three points across a chromatography peak, then the number of cycles during which the precursor ion should not be excluded is at least two.

System for Preventing Exclusion of Convolved Peaks

Figure 8:
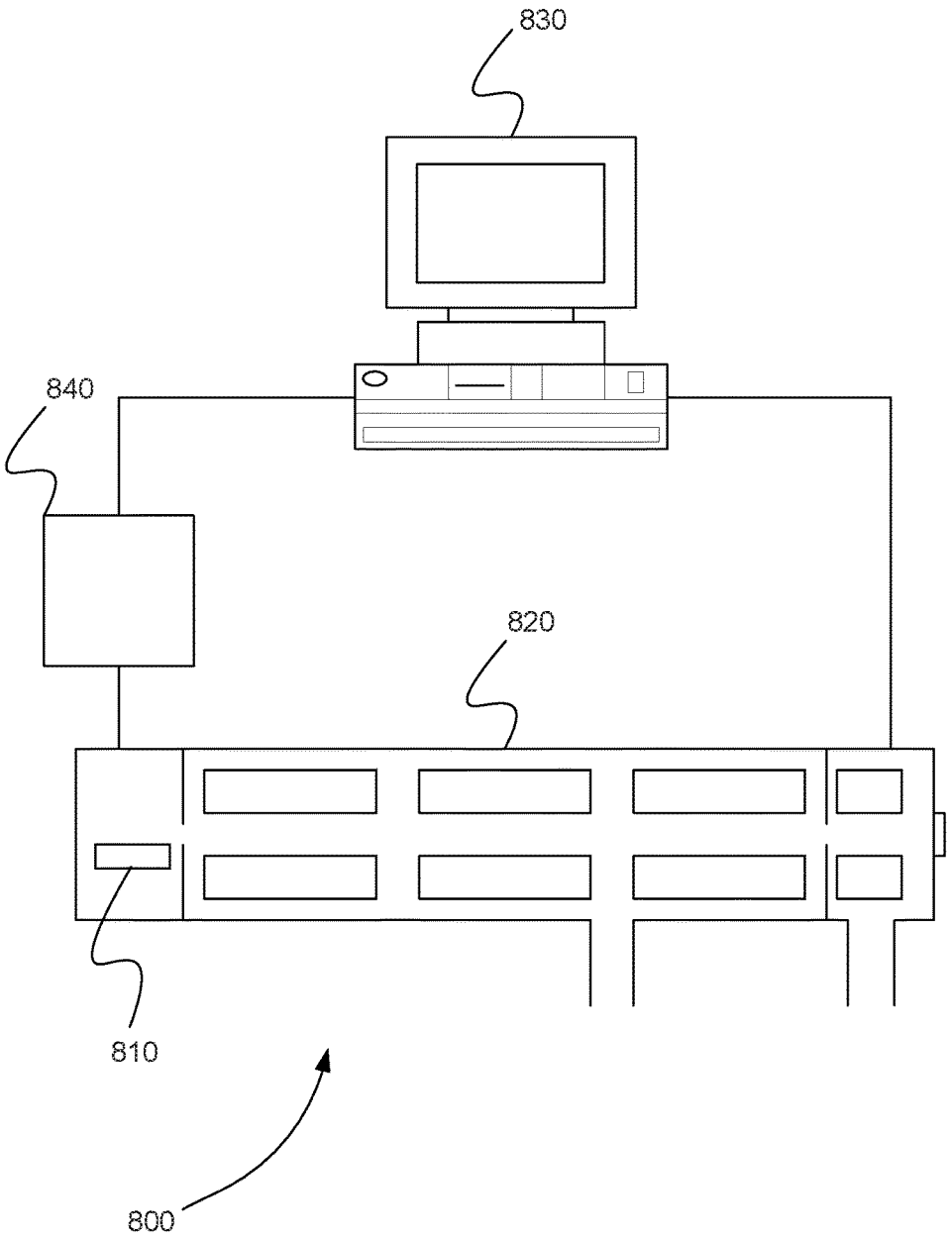
FIG. 8 is a schematic diagram showing a system for preventing potentially convolved precursor ion peaks from being excluded in subsequent cycles of an IDA experiment so that additional product ion data is collected, in accordance with various embodiments.

FIG. 8 is a schematic diagram showing a system 800 for preventing potentially convolved precursor ion peaks from being excluded in subsequent cycles of an IDA experiment so that additional product ion data is collected, in accordance with various embodiments. System 800 includes ion source 810, mass spectrometer 820, and processor 830. Ion source 810 ionizes a sample received over time producing an ion beam.

In various embodiments, system 800 can also include sample introduction device 840. Sample introduction device 840 can provide a sample to ion source 810 over time using one of a variety of techniques. These techniques include, but are not limited to, gas chromatography (GC), liquid chromatography (LC), capillary electrophoresis (CE), or flow injection analysis (FIA).

Mass spectrometer 820 is, for example, a tandem mass spectrometer. A mass analyzer of mass spectrometer 820 can include, but is not limited to, a time-of-flight (TOF), a quadrupole, an ion trap, a linear ion trap, an orbitrap, or a Fourier transform mass analyzer. Mass spectrometer 820 receives the ion beam from ion source 810. As shown in FIG. 8, ion source 810 is part of mass spectrometer 820. One of ordinary skill in the art can understand that in various embodiments ion source 810 can also be thought of as separate devices.

Mass spectrometer 820 is adapted to perform a plurality of cycles of an IDA experiment on the ion beam. Each cycle of the IDA experiment includes a number of steps. In an MS survey scan step, a precursor MS survey scan is performed, producing a precursor ion mass spectrum. In a peak list step, the peaks of the precursor ion mass spectrum are ranked by intensity. In a filtering step, among other things, precursor ions that were fragmented in a previous cycle are excluded from the peak list and a subset of peaks from the peak list with the highest intensities are selected, producing a filtered peak list. In an MS/MS step, an MS/MS scan is performed on each precursor ion on the filtered peak list, producing a product ion spectrum for each MS/MS scan.

Processor 830 can be, but is not limited to, a computer, microprocessor, or any device capable of sending and receiving control signals and data from mass spectrometer 830 and processing data. Processor 830 can be, for example, computer system 100 of FIG. 1. Processor 830 can be the processor used to control mass spectrometer 830, or processor 830 can be an additional processor. Processor 830 can be part of mass spectrometer 820 or can be a separate device. Processor 830 is in communication with ion source 810 and mass spectrometer 820.

During each cycle of the plurality of cycles, processor 830 performs a number of steps for each precursor ion peak on a filtered peak list produced in the filtering step of the cycle. Processor 830 identifies the precursor ion peak in a precursor ion spectrum produced in the MS survey scan step. Processor 830 determines if the precursor ion peak in the precursor ion spectrum includes a feature of convolution. Finally, if the precursor ion peak includes a feature of convolution, processor 830 instructs mass spectrometer 820 to prevent the precursor ion peak from being excluded in a filtering step of one or more subsequent cycles of the plurality of cycles.

In various embodiments, the number of one or more subsequent cycles during which the precursor ion peak is prevented from being excluded is a function of the number of other precursor ion peaks that are found to be convolved with the precursor ion peak in the feature of convolution.

In various embodiments, processor 830 determines if the precursor ion peak in the precursor ion spectrum includes a feature of convolution based on the resolving power of the precursor ion peak. Processor 830 calculates a resolving power, R, of the precursor ion peak according to $R=m/\Delta m$, where m is the mass-to-charge ratio of the precursor ion peak and $\Delta m$ is the FWHM of the precursor ion peak. Processor 830 compares the resolving power, R, to a resolving power of mass spectrometer 820. Finally, if the resolving power, R, of the precursor ion peak is less than the resolving power of mass spectrometer 820, processor 830 determines that the precursor ion peak includes a feature of convolution.

In various embodiments, processor 830 determines if the precursor ion peak in the precursor ion spectrum includes a feature of convolution based on the number of other precursor ion peaks in the MS/MS isolation window of the precursor ion peak. Processor 830 counts the number of other precursor ion peaks located within an isolation window used to fragment the precursor ion represented by the precursor ion peak in the MS/MS step. If the number of other precursor ion peaks is one or more, processor 830 determines that the precursor ion peak includes a feature of convolution.

In various embodiments, processor 830 determines if the precursor ion peak in the precursor ion spectrum includes a feature of convolution based on peak shape of the precursor ion peak. Processor 830 compares a peak shape of the precursor ion peak to a known shape produced by mass spectrometer 820 for a single precursor ion. A known shape produced by mass spectrometer is, for example, a Gaussian shape. If the peak shape differs from the known shape by more than a predetermined threshold, processor 830 determines that the precursor ion peak includes a feature of convolution.

In various embodiments, processor 830 determines if the precursor ion peak in the precursor ion spectrum includes a feature of convolution based on the absence of an isotopic pattern for the precursor ion in the precursor ion spectrum. Processor 830 calculates a pattern of one or more isotopic precursor ion peaks for the precursor ion represented by the precursor ion peak based on the known chemical formula of the precursor ion. Processor 830 compares the pattern to the precursor ion spectrum. If the pattern is not found in the precursor ion spectrum, processor 830 determines that the precursor ion peak includes a feature of convolution.

In various embodiments, processor 830 instructs mass spectrometer 830 to prevent the precursor ion peak from being excluded in a filtering step of one or more subsequent cycles of the plurality of cycles by adding the precursor ion peak to a do not exclude list. During each filtering step of each cycle of the plurality of cycles the do not exclude list is compared to each precursor ion peak selected for exclusion. The precursor ion peak selected for exclusion is not excluded if the precursor ion peak selected for exclusion is on the do not exclude list.

In various embodiments, the do not exclude list also includes for each precursor ion peak the number of cycles during which the peak should not be excluded. Processor 830 then further adds the number of one or more subsequent cycles of the plurality of cycles during which the precursor ion peak is to be excluded to the do not exclude list along with the precursor ion peak.

In various embodiments, the additional product ion data collected for a convolved precursor ion peak is used in real-time to calculate a deconvolved product ion spectrum for the convolved precursor ion peak. For example, processor 830 further calculates a deconvolved product ion spectrum for the precursor ion peak using a product ion spectrum produced for the precursor ion peak during the MS/MS step of the each cycle and each product ion spectrum produced for the precursor ion peak from each MS/MS step of the one or more subsequent cycles.

Method for Preventing Exclusion of Convolved Peaks

Figure 9:
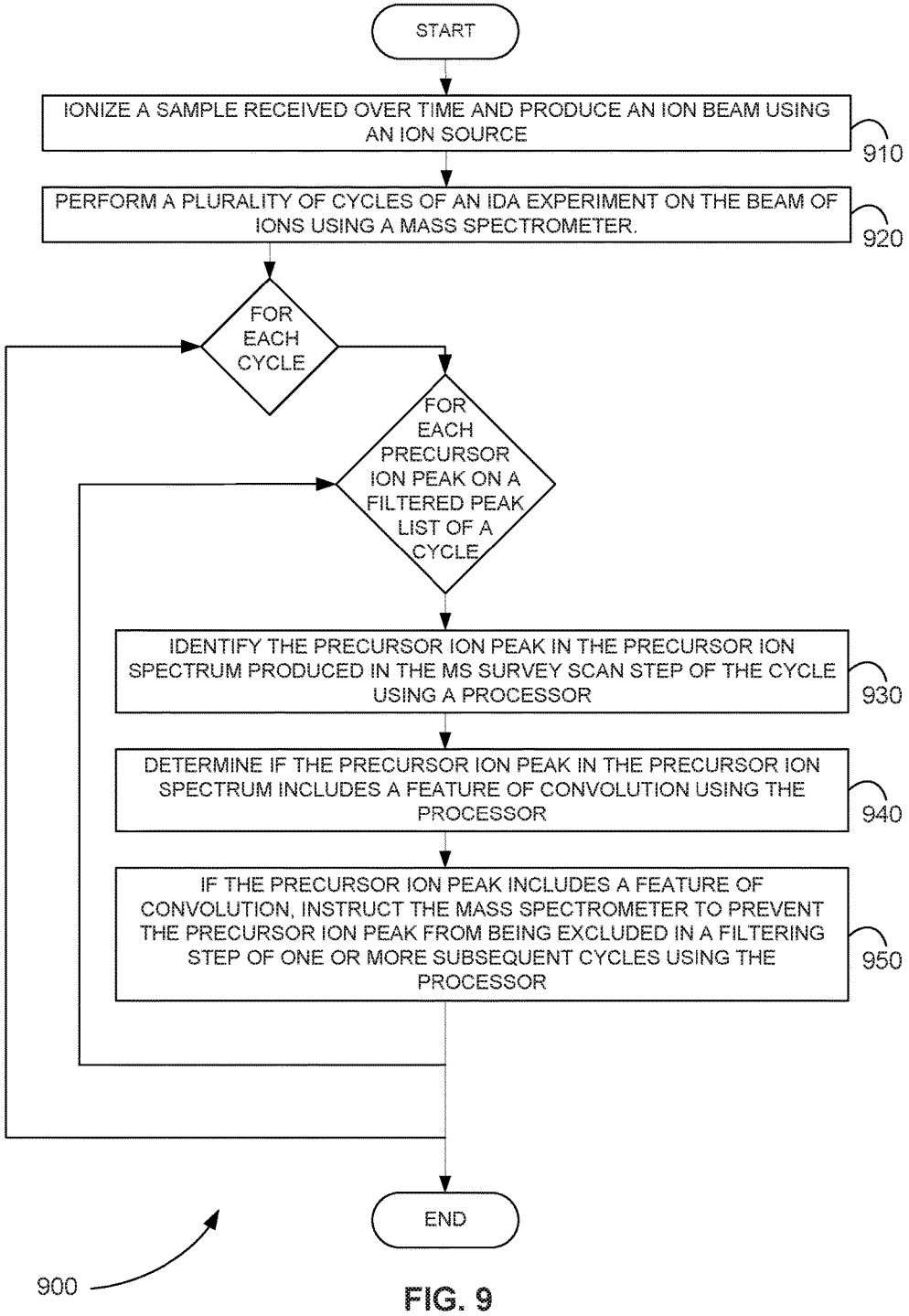
FIG. 9 is a flowchart showing a method for preventing potentially convolved precursor ion peaks from being excluded in subsequent cycles of an IDA experiment so that additional product ion data is collected, in accordance with various embodiments.

FIG. 9 is a flowchart showing a method 900 for preventing potentially convolved precursor ion peaks from being excluded in subsequent cycles of an IDA experiment so that additional product ion data is collected, in accordance with various embodiments.

In step 910 of method 900, a sample received over time is ionized and an ion beam is produced using an ion source.

In step 920, a plurality of cycles of an IDA experiment are performed on the ion beam using a mass spectrometer. Each cycle of the IDA experiment includes a number of steps. In an MS survey scan step, a precursor ion mass spectrum is produced. In a peak list step, the peaks of the precursor ion mass spectrum are ranked by intensity. In a filtering step, precursor ions that were fragmented in a previous cycle are excluded from the peak list and a subset of peaks from the peak list with the highest intensities are selected, producing a filtered peak list. In an MS/MS step, an MS/MS scan is performed on each precursor ion on the filtered peak list, producing a product ion spectrum for each MS/MS scan.

During each cycle of the IDA experiment and for each precursor ion peak on a filtered peak list produced in the filtering step of each cycle, a number of steps are performed.

In step 930, the precursor ion peak is identified in the precursor ion spectrum produced in the MS survey scan step of the cycle using a processor.

In step 940, it is determined if the precursor ion peak in the precursor ion spectrum includes a feature of convolution using the processor.

In step 950, if the precursor ion peak includes a feature of convolution, the mass spectrometer is instructed to prevent the precursor ion peak from being excluded in a filtering step of one or more subsequent cycles using the processor.

Computer Program Product for Preventing Exclusion of Convolved Peaks

In various embodiments, a computer program product includes a tangible computer-readable storage medium whose contents include a program with instructions being executed on a processor so as to perform a method for preventing potentially convolved precursor ion peaks from being excluded in subsequent cycles of IDA experiment so that additional product ion data is collected. This method is performed by a system that includes one or more distinct software modules.

Figure 10:
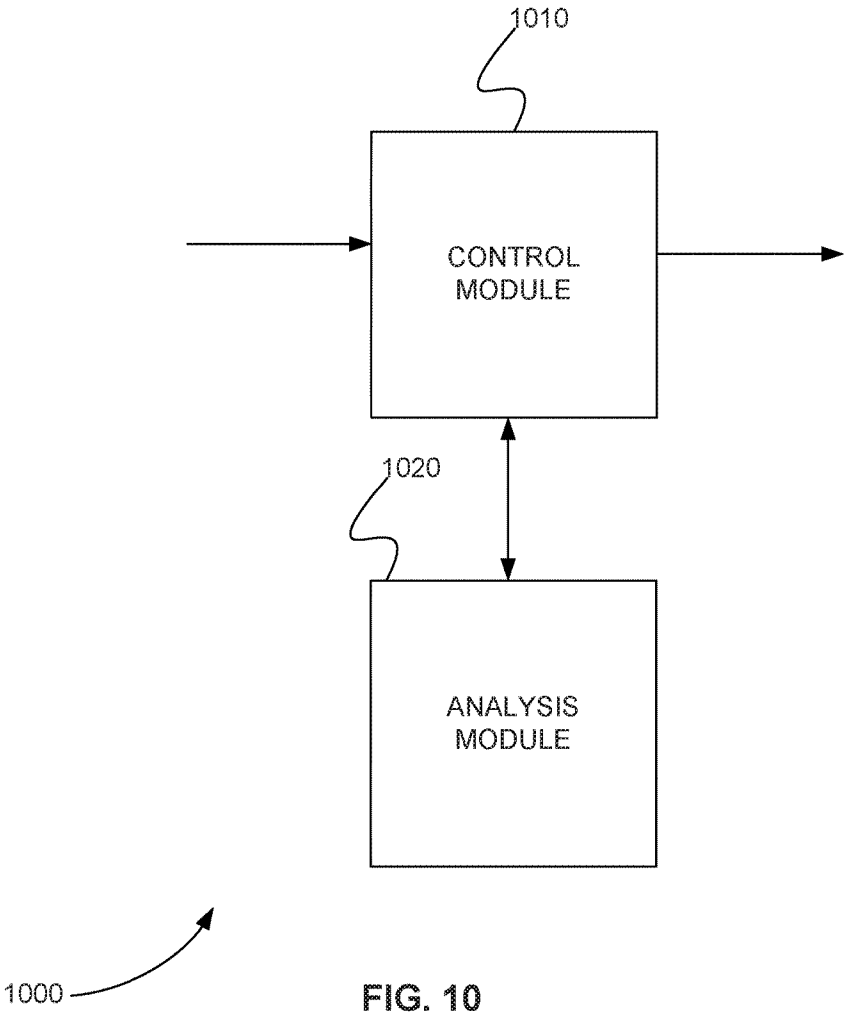
FIG. 10 is a schematic diagram of a system that includes one or more distinct software modules that perform a method for preventing potentially convolved precursor ion peaks from being excluded in subsequent cycles of an IDA experiment so that additional product ion data is collected, in accordance with various embodiments.

FIG. 10 is a schematic diagram of a system 1000 that includes one or more distinct software modules that perform a method for preventing potentially convolved precursor ion peaks from being excluded in subsequent cycles of an IDA experiment so that additional product ion data is collected, in accordance with various embodiments. System 1000 includes control module 1010 and analysis module 1020.

Control module 1010 instructs instruct an ion source to ionize a sample received over time and to produce an ion beam. Control module 1010 instructs instruct a mass spectrometer to perform a plurality of cycles of an IDA experiment on the ion beam. Each cycle of the IDA experiment includes a number of steps. In an MS survey scan step, a precursor MS survey scan is performed, producing a precursor ion mass spectrum. In a peak list step, the peaks of the precursor ion mass spectrum are ranked by intensity. In a filtering step, among other things, precursor ions that were fragmented in a previous cycle are excluded from the peak list and a subset of peaks from the peak list with the highest intensities are selected, producing a filtered peak list. In an MS/MS step, an MS/MS scan is performed on each precursor ion on the filtered peak list, producing a product ion spectrum for each MS/MS scan.

During each cycle of the IDA experiment a number of steps are performed for each precursor ion peak on a filtered peak list produced in the filtering step of the cycle. Analysis module 1020 identifies the precursor ion peak in the precursor ion spectrum produced in the MS survey scan step. Analysis module 1020 determines if the precursor ion peak in the precursor ion spectrum includes a feature of convolution. If the precursor ion peak includes a feature of convolution, control module 1010 instructs the mass spectrometer to prevent the precursor ion peak from being excluded in a filtering step of one or more subsequent cycles of the plurality of cycles of the IDA experiment.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for preventing potentially convolved precursor ion peaks from being excluded in subsequent cycles of an information dependent analysis (IDA) experiment so that additional product ion data is collected, comprising:

an ion source that ionizes a sample received over time producing an ion beam;

a mass spectrometer that receives the ion beam from the ion source and is adapted to perform a plurality of cycles of an IDA experiment on the ion beam, wherein each cycle of the plurality of cycles includes, a mass spectrometry (MS) survey scan step that produces a precursor ion mass spectrum, a peak list step that ranks the peaks of the precursor ion mass spectrum by intensity, a filtering step that excludes from the peak list precursor ions that were fragmented in a previous cycle and selects a subset of peaks from the peak list with the highest intensities producing a filtered peak list, and a mass spectrometry/mass spectrometry step (MS/MS) step during which an MS/MS scan is performed on each precursor ion on the filtered peak list producing a product ion spectrum for each MS/MS scan; and a processor in communication with the mass spectrometer that during each cycle of the plurality of cycles, for each precursor ion peak on a filtered peak list produced in a filtering step, identifies the precursor ion peak in a precursor ion spectrum produced in a MS survey scan step, determines if the precursor ion peak in the precursor ion spectrum includes a feature of convolution, and if the precursor ion peak includes a feature of convolution, instructs the mass spectrometer to prevent the precursor ion peak from being excluded in a filtering step of one or more subsequent cycles of the plurality of cycles.

2. The system of claim 1, wherein the processor determines if the precursor ion peak in the precursor ion spectrum includes a feature of convolution by calculating a resolving power, R, of the precursor ion peak according to $R=m/\Delta m$, where m is the mass-to-charge ratio of the precursor ion peak and $\Delta m$ is the full width at half maximum (FWHM) of the precursor ion peak, comparing the resolving power, R, to a resolving power of the mass spectrometer, and if the resolving power, R, of the precursor ion peak is less than the resolving power of the mass spectrometer, determining that the precursor ion peak includes a feature of convolution.

3. The system of claim 1, wherein the processor determines if the precursor ion peak in the precursor ion spectrum includes a feature of convolution by counting the number of other precursor ion peaks located within an isolation window used to fragment the precursor ion represented by the precursor ion peak in an MS/MS step, and if the number of other precursor ion peaks is one or more, determining that the precursor ion peak includes a feature of convolution.

4. The system of claim 1, wherein the processor determines if the precursor ion peak in the precursor ion spectrum includes a feature of convolution by comparing a peak shape of the precursor ion peak to a known shape produced by the mass spectrometer for a single precursor ion, and if the peak shape differs from the known shape by more than a predetermined threshold, determining that the precursor ion peak includes a feature of convolution.

5. The system of claim 1, wherein the processor determines if the precursor ion peak in the precursor ion spectrum includes a feature of convolution by calculating a pattern of one or more isotopic precursor ion peaks for the precursor ion represented by the precursor ion peak based on the known chemical formula of the precursor ion, comparing the pattern to the precursor ion spectrum, and if the pattern is not found in the precursor ion spectrum, determining that the precursor ion peak includes a feature of convolution.

6. The system of claim 1, wherein the number of one or more subsequent cycles of the plurality of cycles is a function of the number of other precursor ion peaks that are found to be convolved with the precursor ion peak in the feature of convolution.

7. The system of claim 1, wherein the processor instructs the mass spectrometer to prevent the precursor ion peak from being excluded in a filtering step of one or more subsequent cycles of the plurality of cycles by adding the precursor ion peak to a do not exclude list, wherein during each filtering step of each cycle of the plurality of cycles the do not exclude list is compared to each precursor ion peak selected for exclusion and the precursor ion peak selected for exclusion is not excluded if the precursor ion peak selected for exclusion is on the do not exclude list.

8. The system of claim 7, wherein the processor further adds the number of one or more subsequent cycles of the plurality of cycles during which the precursor ion peak is to be excluded to the do not exclude list along with the precursor ion peak.

9. The system of claim 1, wherein the processor further calculates a deconvolved product ion spectrum for the precursor ion peak using a product ion spectrum produced for the precursor ion peak during a MS/MS step of the each cycle and each product ion spectrum produced for the precursor ion peak from each MS/MS step of the one or more subsequent cycles.

10. A method for preventing potentially convolved precursor ion peaks from being excluded in subsequent cycles of an information dependent analysis (IDA) experiment so that additional product ion data is collected, comprising:

ionizing a sample received over time and producing an ion beam using an ion source;

performing a plurality of cycles of an IDA experiment on the beam of ions using a mass spectrometer, wherein each cycle of the plurality of cycles includes, a mass spectrometry (MS) survey scan step that produces a precursor ion mass spectrum, a peak list step that ranks the peaks of the precursor ion mass spectrum by intensity, a filtering step that excludes from the peak list precursor ions that were fragmented in a previous cycle and selects a subset of peaks from the peak list with the highest intensities producing a filtered peak list, and a mass spectrometry/mass spectrometry step (MS/MS) step during which an MS/MS scan is performed on each precursor ion on the filtered peak list producing a product ion spectrum for each MS/MS scan; and during each cycle of the plurality of cycles, for each precursor ion peak on a filtered peak list produced in a filtering step, identifying the precursor ion peak in a precursor ion spectrum produced in a MS survey scan step using a processor, determining if the precursor ion peak in the precursor ion spectrum includes a feature of convolution using the processor, and if the precursor ion peak includes a feature of convolution, instructing the mass spectrometer to prevent the precursor ion peak from being excluded in a filtering step of one or more subsequent cycles of the plurality of cycles using the processor.

11. The method of claim 10, further comprising determining if the precursor ion peak in the precursor ion spectrum includes a feature of convolution by calculating a resolving power, R, of the precursor ion peak according to $R=m/\Delta m$, where m is the mass-to-charge ratio of the precursor ion peak and $\Delta m$ is the full width at half maximum (FWHM) of the precursor ion peak, comparing the resolving power, R, to a resolving power of the mass spectrometer, and if the resolving power, R, of the precursor ion peak is less than the resolving power of the mass spectrometer, determining that the precursor ion peak includes a feature of convolution.

12. The method of claim 10, further comprising determining if the precursor ion peak in the precursor ion spectrum includes a feature of convolution by counting the number of other precursor ion peaks located within an isolation window used to fragment the precursor ion represented by the precursor ion peak in an MS/MS step, and if the number of other precursor ion peaks is one or more, determining that the precursor ion peak includes a feature of convolution.

13. The method of claim 10, further comprising determining if the precursor ion peak in the precursor ion spectrum includes a feature of convolution by comparing a peak shape of the precursor ion peak to a known shape produced by the mass spectrometer for a single precursor ion, and if the peak shape differs from the known shape by more than a predetermined threshold, determining that the precursor ion peak includes a feature of convolution.

14. The method of claim 10, further comprising determining if the precursor ion peak in the precursor ion spectrum includes a feature of convolution by calculating a pattern of one or more isotopic precursor ion peaks for the precursor ion represented by the precursor ion peak based on the known chemical formula of the precursor ion, comparing the pattern to the precursor ion spectrum, and if the pattern is not found in the precursor ion spectrum, determining that the precursor ion peak includes a feature of convolution.

15. A computer program product, comprising a non-transitory and tangible computer-readable storage medium whose contents include a program with instructions being executed on a processor so as to perform a method for preventing potentially convolved precursor ion peaks from being excluded in subsequent cycles of an information dependent analysis (IDA) experiment so that additional product ion data is collected, the method comprising:

providing a system, wherein the system comprises one or more distinct software modules, and wherein the distinct software modules comprise a control module and an analysis module;

instructing an ion source to ionize a sample received over time and to produce an ion beam using the control module;

instructing a mass spectrometer to perform a plurality of cycles of an IDA experiment on the ion beam using the control module, wherein each cycle of the plurality of cycles includes, a mass spectrometry (MS) survey scan step that produces a precursor ion mass spectrum, a peak list step that ranks the peaks of the precursor ion mass spectrum by intensity, a filtering step that excludes from the peak list precursor ions that were fragmented in a previous cycle and selects a subset of peaks from the peak list with the highest intensities producing a filtered peak list, and a mass spectrometry/mass spectrometry step (MS/MS) step during which an MS/MS scan is performed on each precursor ion on the filtered peak list producing a product ion spectrum for each MS/MS scan; and during each cycle of the plurality of cycles, for each precursor ion peak on a filtered peak list produced in a filtering step, identifying the precursor ion peak in a precursor ion spectrum produced in a MS survey scan step using the analysis module, determining if the precursor ion peak in the precursor ion spectrum includes a feature of convolution using the analysis module, and if the precursor ion peak includes a feature of convolution, instructing the mass spectrometer to prevent the precursor ion peak from being excluded in a filtering step of one or more subsequent cycles of the plurality of cycles using the control module.

* * * * *